United States Patent [19]

Duggan

[11] Patent Number: 4,749,182

[45] Date of Patent: Jun. 7, 1988

[54] VARIABLE RESISTANCE AEROBIC EXERCISE MACHINE

[76] Inventor: William V. Duggan, 44 Locust St., Winthrop, Mass. 02152

[21] Appl. No.: 32,355

[22] Filed: Mar. 30, 1987

[51] Int. Cl.[4] ..... A63B 23/04

[52] U.S. Cl. ..... 272/73; 272/131; 272/134; 188/2 D; 188/83

[58] Field of Search ..... 272/72, 73, 73.1, 128, 272/131, 132, 134, DIG. 2; 74/569, 501 R, 501.5; 188/2 D, 83, 196 V

[56] References Cited

U.S. PATENT DOCUMENTS

| | | | |
|---|---|---|---|
| 1,950,896 | 3/1934 | Luzzi | 272/72 |
| 3,376,672 | 4/1968 | Schmidt | 74/501 R X |
| 3,833,216 | 9/1974 | Philbin | 272/73 |
| 4,082,265 | 4/1978 | Berkes | 272/73.1 |
| 4,471,859 | 9/1984 | Urban | 74/569 X |
| 4,519,603 | 5/1985 | DeCloux | 272/73 |
| 4,521,012 | 6/1985 | Cosby et al. | 272/73 |
| 4,645,200 | 2/1987 | Hix | 272/73 |
| 4,688,790 | 8/1987 | Hokajärvi | 272/73 |

*Primary Examiner*—Richard J. Apley
*Assistant Examiner*—David J. Bender
*Attorney, Agent, or Firm*—John P. McGonagle

[57] ABSTRACT

An exercise apparatus for the upper extremities and upper torso. The apparatus includes a pair of handles joined to a crank interconnected by a sprocket chain to a flywheel against which a cam actuated brake is adjustably engaged. The cam actuated brake is controlled by either foot thereby eliminating the necessity of interrupting the exercise regimen to vary exercise load. The apparatus is also adjustable to accomodate different sized users.

5 Claims, 5 Drawing Sheets

VARIABLE RESISTANCE AEROBIC EXERCISE MACHINE

BACKGROUND OF THE INVENTION

This invention relates to exercise apparatus, and more particularly to an adjustable and variable resistance exercise apparatus for exercising the upper extremities and upper torso of the exerciser.

One type of generic apparatus for exercising the upper extremities and upper torso that is known in the prior art comprises hand cranks generally connected by a chain and sprocket with a flywheel against which a brake device is adjustably engaged. The prior art includes a number of patents covering various versions of this type of exercise apparatus, each having particular strengths and weaknesses. U.S. Pat. No. 4,521,012 to T. E. Cosby et al. discloses a variable resistance exercise apparatus adapted to exercise the upper extermities and upper body portion of the exerciser. The hand crank assembly is adjustable to accomodate different sized exercisers. The load or drag on the crank may be varied by means of a lever positioned near the midsection of the exerciser.

U.S. Pat. No. 3,309,084 to H. C. Simmons discloses a hand crank operated portable exercise apparatus utilizing a plate disposed resting on the ground and a framework extending upwardly from the plate. A wheel is journaled to the frame work and is operated by a pair of hand cranks driving a chain coupled to the wheel. A brake apparatus engages a point on the surface of the periphery of the wheel and utilizes an adjustably applied force thereto acting as a brake. U.S. Pat. No. 3,224,765 to E. H. Baker et al. teaches a pair of handles operating a wheel contained within a housing. The wheel is substantially encircled by a pair of semicircular brake elements which adjustably bear upon the periphery of the wheel so as to create a drag force. The housing is secured to a mounting surface in a fixed position, utilizing three tripod-like legs therefor.

U.S. Pat. No. 2,783,044 to D. G. Sbarra discloses an exercising machine comprised of hand cranks connected to a chain and sprocket with a flywheel against which a retarding roller is adjustably engaged. U.S. Pat. No. 1,820,372 to A. E. R. Blomquist discloses an exercising machine involving a crank action for the hands and a pedestal action for the feet that are geared together. An adjustable brake band is provided to variably resist the arm and leg action of the user.

The above devices all have a major limitation. Specifically, all require the use of one or more hands to adjust drag on the hand cranks. This in turn requires the exerciser to temporarily interupt his exercise regimen to vary the exercise load. Since the exerciser must stop exercising when adjusting drag, he must guess how much to change the drag setting and then try operating the machine to find out how much drag results.

SUMMARY OF THE INVENTION

The present invention is an exercise apparatus for the upper extremities and upper torso, and is designed to overcome the limitations of the prior art. The apparatus includes a pair of hand cranks interconnected by sprocket chain to a flywheel against which a braking device is adjustably engaged. The braking device is controlled by either foot thereby eliminating the necessity of interupting the exercise regimen to vary exercise load. The device is also adjustable to accomodate different sized users.

DETAILED DESCRIPTION OF THE INVENTION

Figure 1:
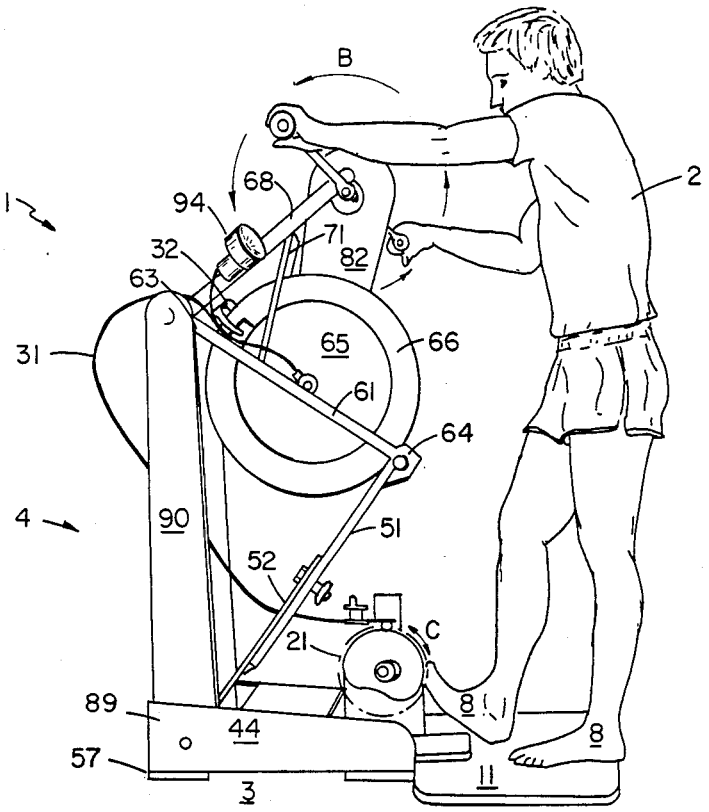
FIG. 1 is a perspective left side view of the aerobic exercise machine of the present invention shown in use by an exerciser.

Referring more particularly to the drawings in detail wherein like numerals indicate like elements, reference numeral 1 refers generally to the aerobic exercise machine comprising the present invention. The machine 1 is comprised of a main frame 40, subframe assembly 60, brake assembly 20, and platform 10.

The main frame 40 stands on the floor 3 and holds the subframe assembly 60 and the brake assembly 20. The main frame 40 is comprised of a base 41, vertical section 46, and adjustable support section 50. The base 41 includes two flat pieces 42 and 43 horizontally placed and transversely positioned toward the front 4 and rear 5 of the machine 1 on the floor 3. The main frame 40 rests on these two pieces 42 and 43. The vertical section 46 rests on the front piece face 58 near the front piece front side 57. The base 41 also includes two longish flat pieces 44 and 45 vertically placed on their sides across the faces 58 and 59 of the pieces 42 and 43 on the left 6 and right 7 sides of the machine 1. The side pieces 44 and 45 are fixedly attached at their forward ends 89 to the sides 90 of the vertical section 46 and the front piece face 58. The side pieces 44 and 45 extend rearwardly where they rest on and are attached to the rear piece face 59.

A horizontal rod 48 is transversely inserted through the forward end 89 of the left side piece 44, through the lower vertical section sides 90, and through the forward end 89 of the right side piece 45. The vertical section 46 has a component 91 interconnecting its sides 90. The upper portion of the component 91 has a generally T-shaped opening. A horizontal rod-like member 49 is transversely positioned and attached through and near the upper ends 47 of the vertical section sides 90. The lower rod 48 and rod-like member 49 lie in a generally vertical plane parallel to each other. The adjustable support section 50 is pivotally attached at its lower end to the lower rod 48. The adjustable support section 50 is comprised of flat, elongated upper and lower members 51 and 52 interconnected by wing nut-bolt fasteners 53 through the face of the lower member 52 near its upper end, through elongated aperture 54 in and running nearly the length of the upper member 51 along its longitudinal axis. The effective length of the adjustable support section 50 may be adjusted thereby.

The platform 10 rests on the floor 3 and the exerciser 2 stands on it while operating the machine 1. The platform 10 is comprised of a generally flat, rectangular-shaped, non-skid, rubber surface 11 with a flat, rectangular-shaped main frame base attaching member 13. The member 13 is connected to the surface 11 near the approximate midpoint of one of the surface's long sides 12, and extends perpendicularly away from said side 12 in a plane parallel to the plane of the surface 11. The width of the extending member 13 is approximately equal to the perpendicular distance between main frame base sides 44 and 45. The length 14 of the portion of the member 13 extending from the surface's side 12 is approximately equal to the width of the main frame rear piece's face 59. The far end 15 of the member 13 terminates in a vertically downward extending flange 16, whose projection is approximately equal to the thickness of the main frame base rear piece 43. The platform 10 attaches to the main frame base 41 by placing the member 13 between the side pieces 44 and 45, over the rear piece face 59 so that the member's flange 16 hooks over the front side 55 of the main frame base rear piece 43.

The subframe assembly 60 includes a parallel-bar yoke 61 supporting at its approximate midpoint a flywheel 65 which is rotatably attached thereto. One end 63 of the yoke 61 is pivotally attached to the rod-like member 49 of the main frame's vertical section 46. The other end 64 of the yoke 61 is pivotally attached to the uppermost end 56 of the adjustable support section's upper member 51. Extending outwardly and upwardly from the rod-like member 49 over the flywheel 65 at an approximate upward seventy-five degree vertical angle from the yoke 61 is a shaft 68. The shaft 68 is pivotally attached to the rod-like member 49 and lies in the same vertical plane as the flywheel 65. An inverted U-shaped member 69 with each tip 70 fixedly attached to a yoke bar 62 supports the shaft 68 with its trough 71. The subframe assembly 60 also includes a set of handles 73 on a crank 74 which turns on a hub bearing 76. The hub bearing 76 is contained within a housing 77 fixedly attached to the shaft end 72 opposite to the end connected to the rod-like member 49. The crank 74 has about it a sprocket 78. The flywheel 65 also has fixedly attached to its center a sprocket wheel 67. The sprocket 78 and sprocket wheel 67 lie in the same vertical plane and are interconnected by means of a sprocket drive chain 79. An indler wheel 80, slidably attached by means of a member 81 to one of the yoke bars 62, provides adjustable tensioning to the sprocket drive chain 79 thus eliminating the tendency of the chain 79 to chatter or slip off the sprocket 78 or sprocket wheel 67. A chain guard 82 encloses the sprocket 78, sprocket wheel 67, sprocket drive chain 79 and sprocket wheel 67.

Figure 4:
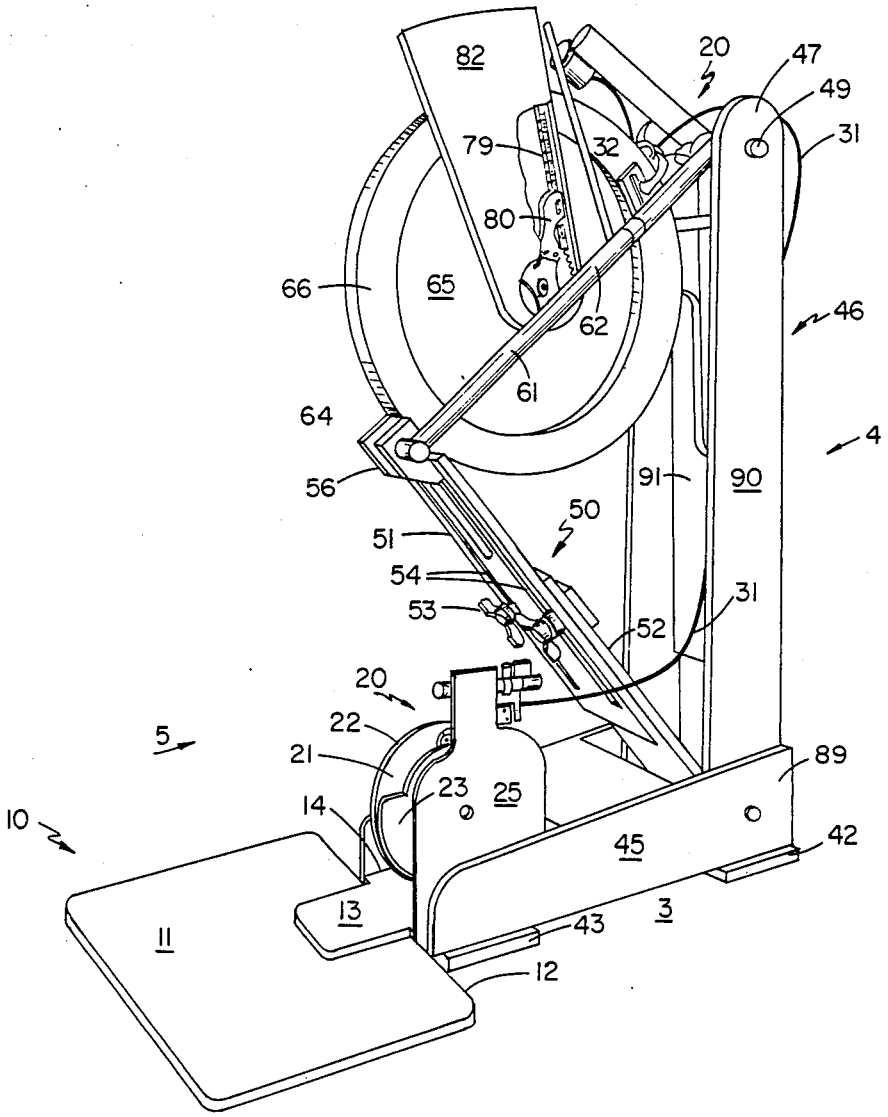
FIG. 4 is a perspective right rear view of the invention of FIG. 1 without the hand crank assembly and with a portion of the chain guard cut away.
Figure 5:
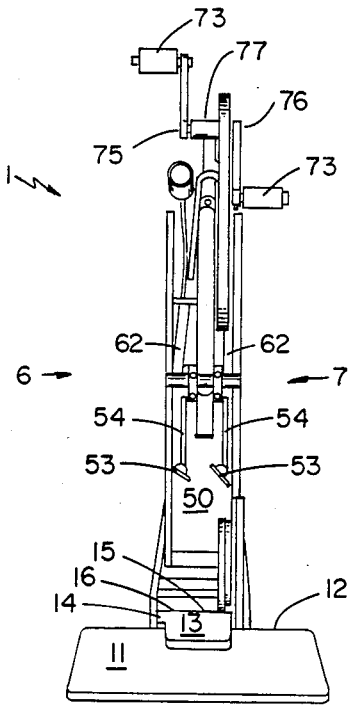
FIG. 5 is a rear elevational view of the invention of FIG. 1.
Figure 6:
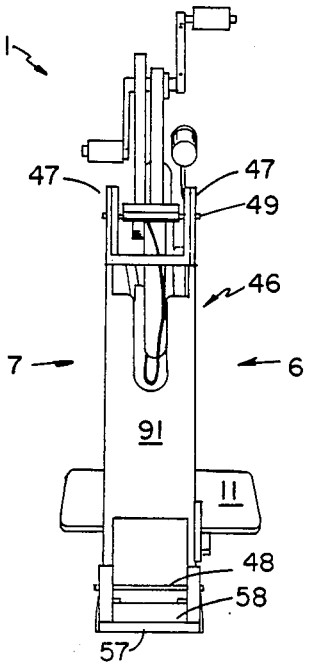
FIG. 6 is a front elevational view of the invention of FIG. 1.
Figure 8:
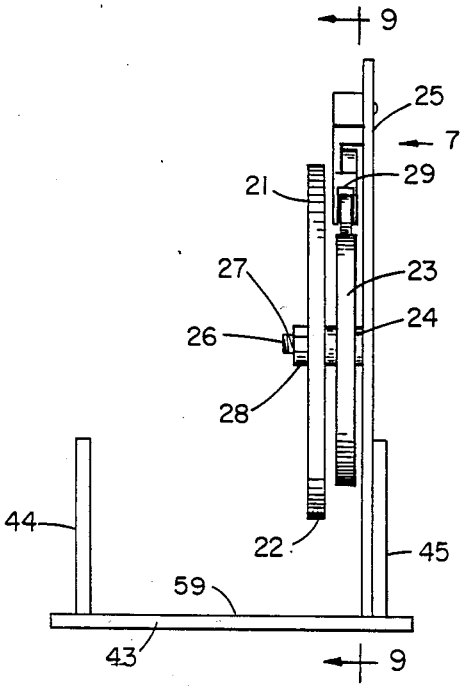
FIG. 8 is a rear elevational view of a portion of the brake assembly of the invention of FIG. 1.
Figure 9:
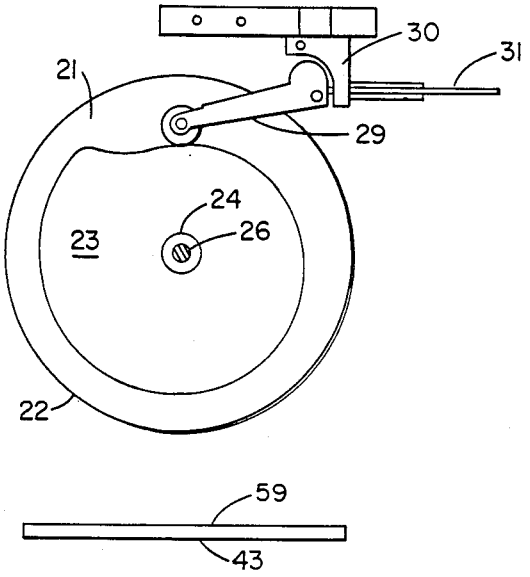
FIG. 9 is a cross-sectional view along the plane 9—9 of that portion of the invention illustrated in FIG. 8.

The brake assembly 20 is most clearly illustrated in FIGS. 4, 8, and 9, and is comprised of an actuator disc 21, a spiral cam 23, a cam follower 29, a remote brake control 30, a brake cable 31, and caliper brakes 32. Toward the rear portion of the main frame base right side piece 45 there is a flat, vertically upright member 25 attached thereto in a vertical plane parallel to the plane of the right side piece 45. A short, horizontal shaft 26 extends centrally from the upright member 25 in a direction toward the left side 6 of the machine 1, transverse to the plane of the upright member 25. A flat washer 24 is placed onto the shaft 26 against the upright member 25. A spiral cam 23 is rotatably positioned onto the shaft 26 against the washer 24. An actuator disc 21 is rotatably positioned onto the shaft 26 and fixedly fastened to the spiral cam 23, but positioned with an approximate one-eighth inch separation between cam 23 and disc 21. The shaft end 27 opposite to the upright member 25 is threaded. A nut 28 is screwed onto the shaft end 27, thereby holding the disc 21, cam 23, and washer 24 in place against the upright member 25. The tightness of the nut 28 will determine the ease in which the cam 23 and disc 21 may be turned. A cam follower 29 is attached to the upright member 25 and positioned so that it can follow the radial changes in the cam 23. The remote brake control 30 joins the cam follower 29 with a brake cable 31 so that radial changes in the cam 23 are translated through the cam follower 29 and remote brake control 30 as tension changes to the brake cable 31. The brake cable 31 is fed to caliper brakes 32 mounted about the sides 66 of the flywheel 65. The disc has a treaded rubber surface 22 about its periphery. The cam 23 and disc 21 are so attached that they rotate together o the shaft 26.

OPERATION

Figure 2:
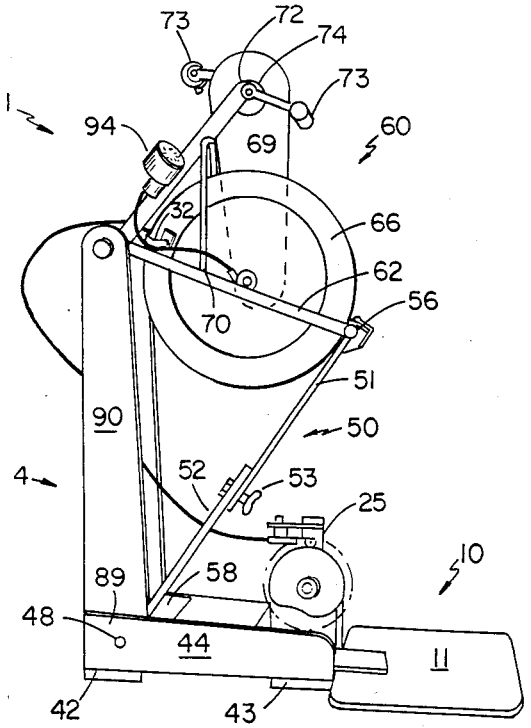
FIG. 2 is a perspective left side view of the invention of FIG. 1 adjusted to its maximum height.
Figure 3:
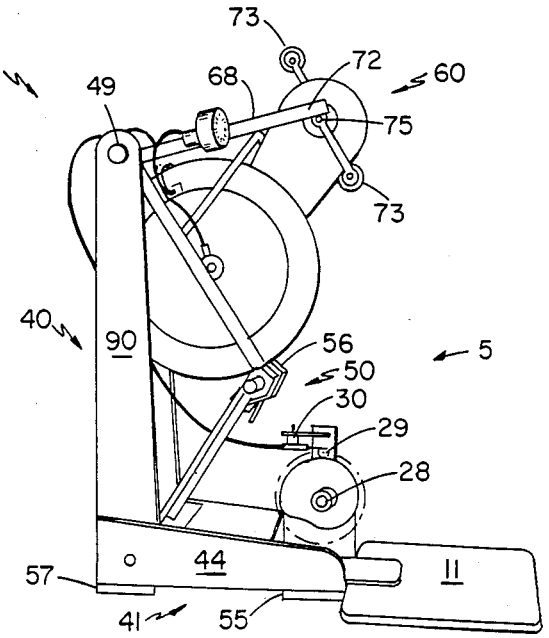
FIG. 3 is a perspective left side view of the invention of FIG. 1 adjusted to its lowest height.
Figure 7:
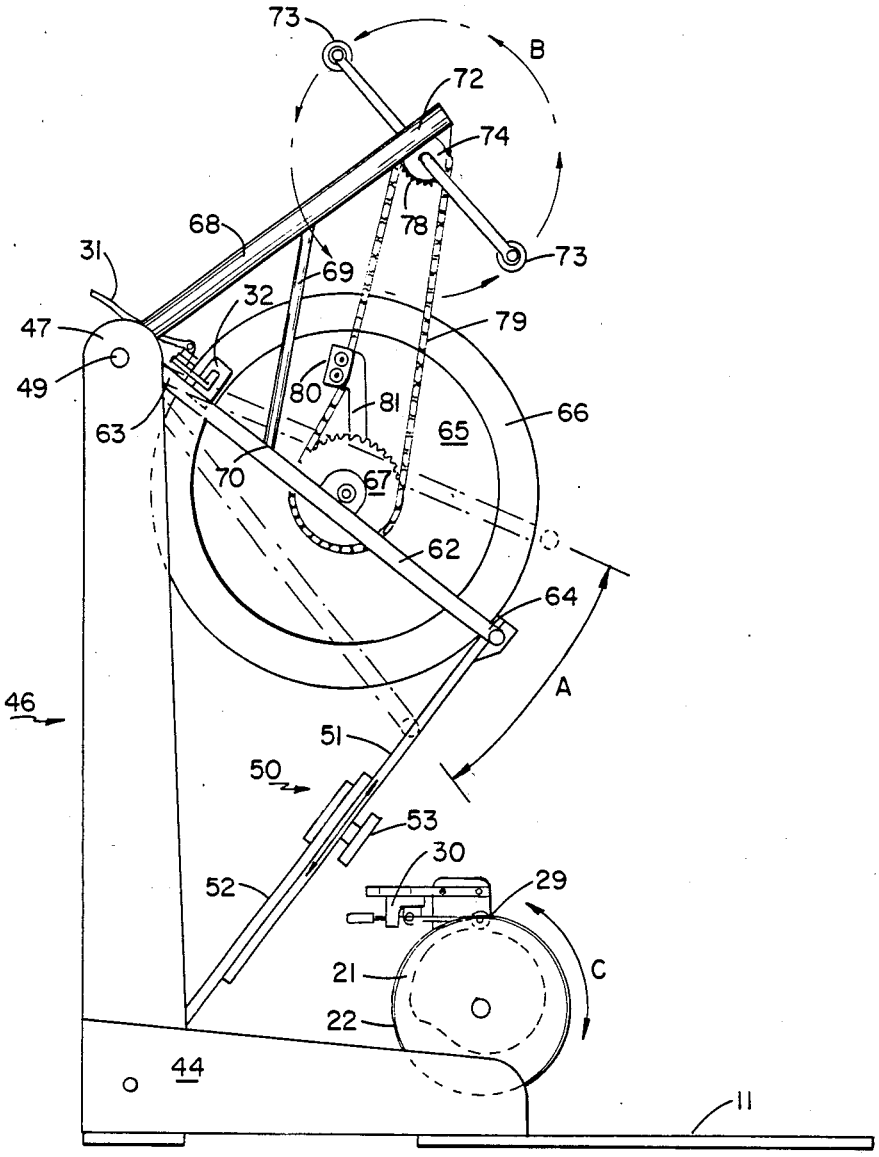
FIG. 7 is a diagrammic view of the invention of FIG. 1 illustrating the interaction between major components.

In this embodiment of the invention, the overall height of the machine 1 is preset by the exerciser 2 as may be most clearly seen in FIGS. 2, 3, and 7. The wing nut-bolt fasteners 53 are loosened and the subframe assembly 60 is moved through a range "A" by extending or contracting the adjustable support section 50. When the subframe assembly is at its desired height, the fasteners 53 are tightened. FIG. 2 illustrates the machine 1 at its maximum elevation. FIG. 3 illustrates the machine 1 at its minimum elevation.

FIG. 1 illustrates an exerciser 2 operating the machine 1. The exerciser 2 stands on the platform surface 11 and turns the handles 73 and crank 74 which in turn transmits a turning force through the chain 79, sprocket wheel 67 and to the flywheel 65. This rotation motion "B" is resisted by the caliper brakes 32 acting as a drag on the flywheel 65 thereby effecting the exercise load. Brake tension on the flywheel sides 66 is controlled by the exerciser's foot 8. The exerciser 2 moves the actuator disc 21 by up or down foot pressure "C" against the treaded rubber surface 22. This causes the disc 21 and the cam 23 to move accordingly with consequent effect on the cam follower 29. The action on the cam follower 29 is translated via the remote brake control 30 to the brake cable 31 and ultimately to the caliper brakes 32. Tightening or loosening the brakes 32 increases or decreases drag on the flywheel 65 and thereby the resistance to rotation B of the handles 73. Exercise load may, therefore, be varied without interuption of the exercise regimen. The exerciser 2 can vary brake drag while continuously turning the handles 73 and crank 74. The brakes 32 are operating in sliding friction against the flywheel 65 and any change in the caliper brake 32 clamping force against the flywheel 65 is instantly transmitted to the exerciser 2 by means of the force required to keep the handles 73 turning. In operation the exerciser 2 may gradually tighten the brakes 32 by increasing tension on the brake cable 31 while cranking at a more or less constant speed as he warms up. Once he has warmed up he may keep the brake tension constant or vary it to provide periods of maximum work with periods of less work. During the cool down period at the end of the exercise time, the brakes 32 may be gradually released to reduce the effort over a period of time.

It is understood that the above-described embodiment is merely illustrative of the application. A speedometer 94 may be mounted on the shaft 68 so that the exerciser 2 may better control rotation B and load. An ergometer may also be added. Other embodiments, therefore, may be readily devised by those skilled in the art which will embody the principles of the invention and fall within the spirit and scope thereof.

I claim:

1. An aerobic exercise machine for the upper extremities and upper torso, comprising:

a main frame supporting a subframe assembly containing a set of handles on a crank interconnected to a flywheel and a foot-operated brake assembly adjustably engaged to said flywheel, said main frame having a base, a vertical section connected to said base, and an adjustable support section with two ends, one end of which is pivotally connected to the junction of said base and said vertical section;

wherein said subframe assembly further contains a parallel-bar yoke supporting at its approximate midpoint said flywheel, one end of which yoke is pivotally attached to said vertical section, and the other end of which yoke is pivotally attached to said adjustable support section, a shaft, one end of which is pivotally connected to said vertical section, extending outwardly and upwardly over said yoke, and having rotatably attached to its other end said crank, and a support member attached to said yoke and supporting said shaft, wherein said flywheel is rotatably attached to said yoke and has fixedly attached to its center a sprocket wheel, and wherein said crank has about it a sprocket which lies in the same vertical plane as, and is interconnected to said sprocket wheel by means of a sprocket drive chain;

a platform connected to said base; and wherein said foot-operated brake assembly contains a spiral cam, an actuator disc having a treaded rubber surface about its periphery wherein said disc is fixedly attached to said spiral cam in a plane parallel to the plane of said spiral cam, a cam follower positioned to follow the radial changes in said spiral cam, a brake cable, a remote brake control joining said cam follower with said brake cable so that radial changes in said spiral cam are translated through said cam follower and remote brake control as tension changes to said brake cable, and braking means mounted about the flywheel and connected to, and sensitive to tension changes in, said brake cable.

2. An aerobic exercise machine as recited in claim 1 wherein:

the length of said adjustable support section may be increased or decreased.

3. An aerobic exercise machine as recited in claim 2 wherein:

said braking means are caliper brakes.

4. An aerobic exercise machine as recited in claim 3 further comprising:

an idler wheel slideaby attached by means of a member to one of said yoke bars wherein said wheel provides adjustable tensioning to said sprocket drive chain.

5. An aerobic exercise machine as recited in claim 4, wherein:

said platform is removably connected to said base.

* * * * *